US005332215A

United States Patent [19]

Gonzales

[11] Patent Number: 5,332,215

[45] Date of Patent: Jul. 26, 1994

[54] FOOTBALL BOARD GAME

[76] Inventor: David J. Gonzales, P.O. Box 432, Patterson, Calif. 95363

[21] Appl. No.: 31,277

[22] Filed: Mar. 15, 1993

[51] Int. Cl.[5] ..... A63F 7/06

[52] U.S. Cl. ..... 273/94; 273/286; 273/239; 273/285; 273/DIG. 30

[58] Field of Search ..... 273/94, 85 R, 126 R, 273/126 A, 239, 247, 285, 286, DIG. 30

[56] References Cited

U.S. PATENT DOCUMENTS

| | | | |
|---|---|---|---|
| 1,523,684 | 1/1925 | Canale et al. | 273/94 R |
| 1,603,717 | 10/1926 | Rubino et al. | 273/94 R |
| 1,819,932 | 8/1931 | Walden | 273/85 R |
| 2,263,115 | 11/1941 | Winter | 273/94 R |
| 2,330,951 | 10/1943 | Burmester et al. | 273/94 R |
| 2,517,460 | 8/1950 | Arnn | 273/94 R |
| 2,528,938 | 11/1950 | Wolf | 273/94 R |
| 3,043,594 | 7/1962 | Seitz | 273/94 R |
| 3,091,459 | 5/1963 | Lindman | 273/94 R X |
| 3,926,439 | 12/1975 | Chao et al. | 273/237 |
| 5,209,487 | 5/1993 | Rizzo | 273/148 R X |

FOREIGN PATENT DOCUMENTS

| | | | |
|---|---|---|---|
| 1501915 | 11/1967 | France | 273/286 |
| 2562434 | 10/1985 | France | 273/286 |

*Primary Examiner*—V. Millin
*Assistant Examiner*—Sebastiano Passaniti
*Attorney, Agent, or Firm*—E. Michael Combs

[57] ABSTRACT

A football board game is arranged to simulate football play employing a passing attack as the sole means of advancing each team along the game board, that in turn is arranged for furled mounting about a storage mandrel. Advancing of the players is effected by striking the game ball, that in turn is to strike a target offensive player, wherein defensive players are positioned by an opponent to interfere with such completion. Conventional football rules relative to the number of downs and the like are employed in use of the game apparatus.

2 Claims, 5 Drawing Sheets

FIG. 5
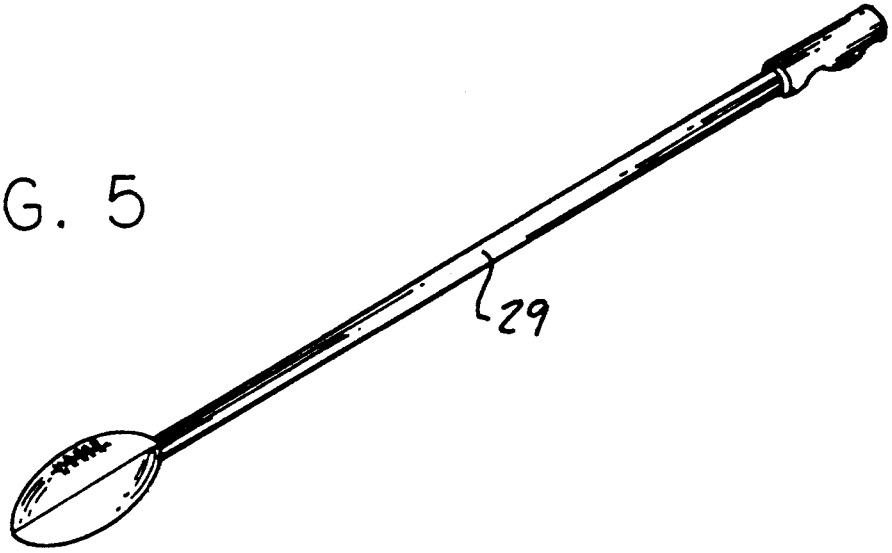
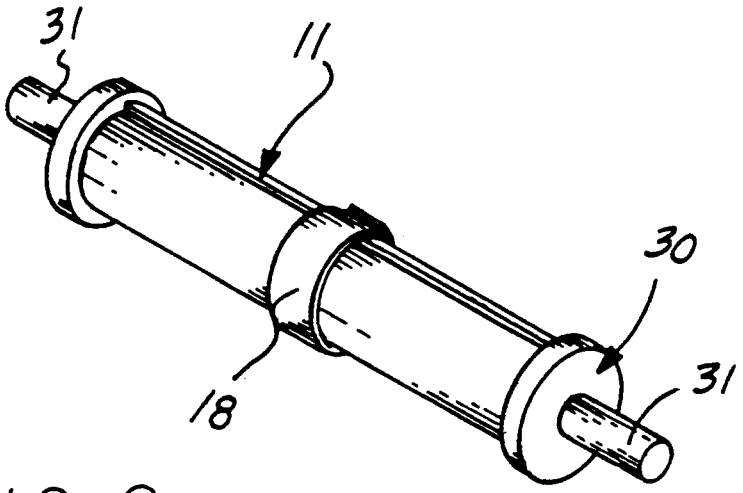
FIG. 6

FOOTBALL BOARD GAME

BACKGROUND OF THE INVENTION

1. Field of the Invention

The field of invention relates to football game apparatus, and more particularly pertains to a new and improved football board game wherein the same is directed to employing a bat to strike a game ball to effect contact with an opposing player.

2. Description of the Prior Art

Game boards of various types have been utilized in the prior art, wherein U.S. Pat. No. Des. 294,508 indicates a conventional layout of a football game board. Further, the U.S. Pat. Nos. 3,995,863; 5,039,107; 5,074,557; and 4,989,879 are examples of prior art football game apparatus.

The instant invention addresses a novel and new manner of entertainment and enjoyment in the use of a football game structure, wherein the same is directed to the employment of a passing attack and limited thereto to direct football progress along the simulated football field and in this respect, the present invention substantially fulfills this need.

SUMMARY OF THE INVENTION

In view of the foregoing disadvantages inherent in the known types of football board game apparatus now present in the prior art, the present invention provides a football board game wherein the same is directed to the employment of a bat-like member to strike a game ball in an effort to strike various target players permitting proceeding of the football play along the game board. As such, the general purpose of the present invention, which will be described subsequently in greater detail, is to provide a new and improved football board game which has all the advantages of the prior art football board game structure and none of the disadvantages.

To attain this, the present invention provides a football board game arranged to simulate football play employing a passing attack as the sole means of advancing each team along the game board, that in turn is arranged for furled mounting about a storage mandrel. Advancing of the players is effected by striking the game ball, that in turn is to strike a target offensive player, wherein defensive players are positioned by an opponent to interfere with such completion. Conventional football rules relative to the number of downs and the like are employed in use of the game apparatus.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved football board game which has all the advantages of the prior art football board game structure and none of the disadvantages.

It is another object of the present invention to provide a new and improved football board game which may be easily and efficiently manufactured and marketed.

It is a further object of the present invention to provide a new and improved football board game which is of a durable and reliable construction.

An even further object of the present invention is to provide a new and improved football board game which is susceptible of a low cost of manufacture with regard to both materials and labor, and which accordingly is then susceptible of low prices of sale to the consuming public, thereby making such football board games economically available to the buying public.

Still yet another object of the present invention is to provide a new and improved football board game which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is an isometric illustration of the bat member employed by the invention.

FIG. 6 indicates an isometric illustration of the storage mandrel arranged for storing the game board during periods of non-use.

DESCRIPTION OF THE PREFERRED EMBODIMENT

Figure 1:
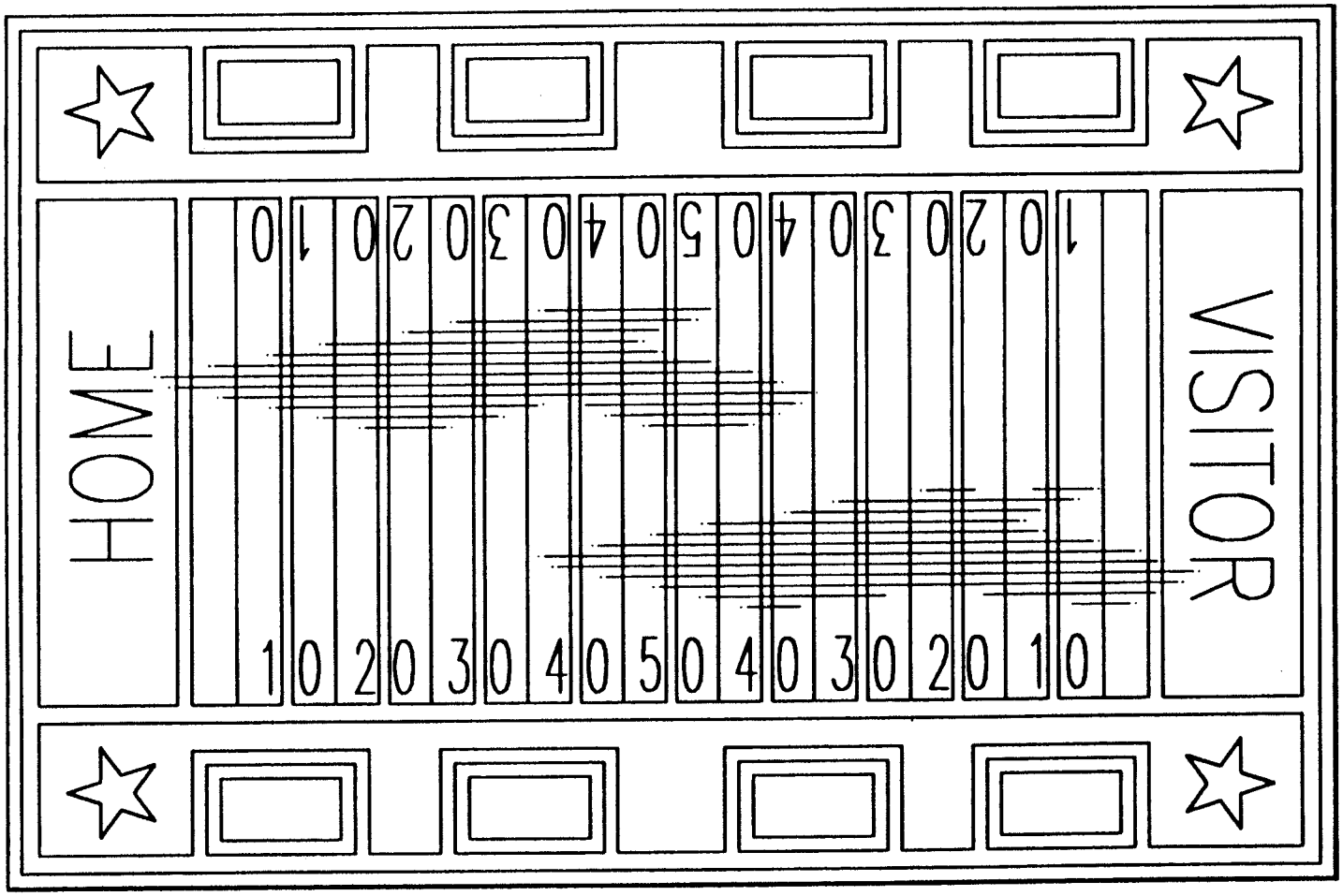
FIG. 1 PRIOR ART
FIG. 1 is an orthographic view of a prior art football game board, as indicated in U.S. Pat. No. Des. 294,508.
Figure 2:
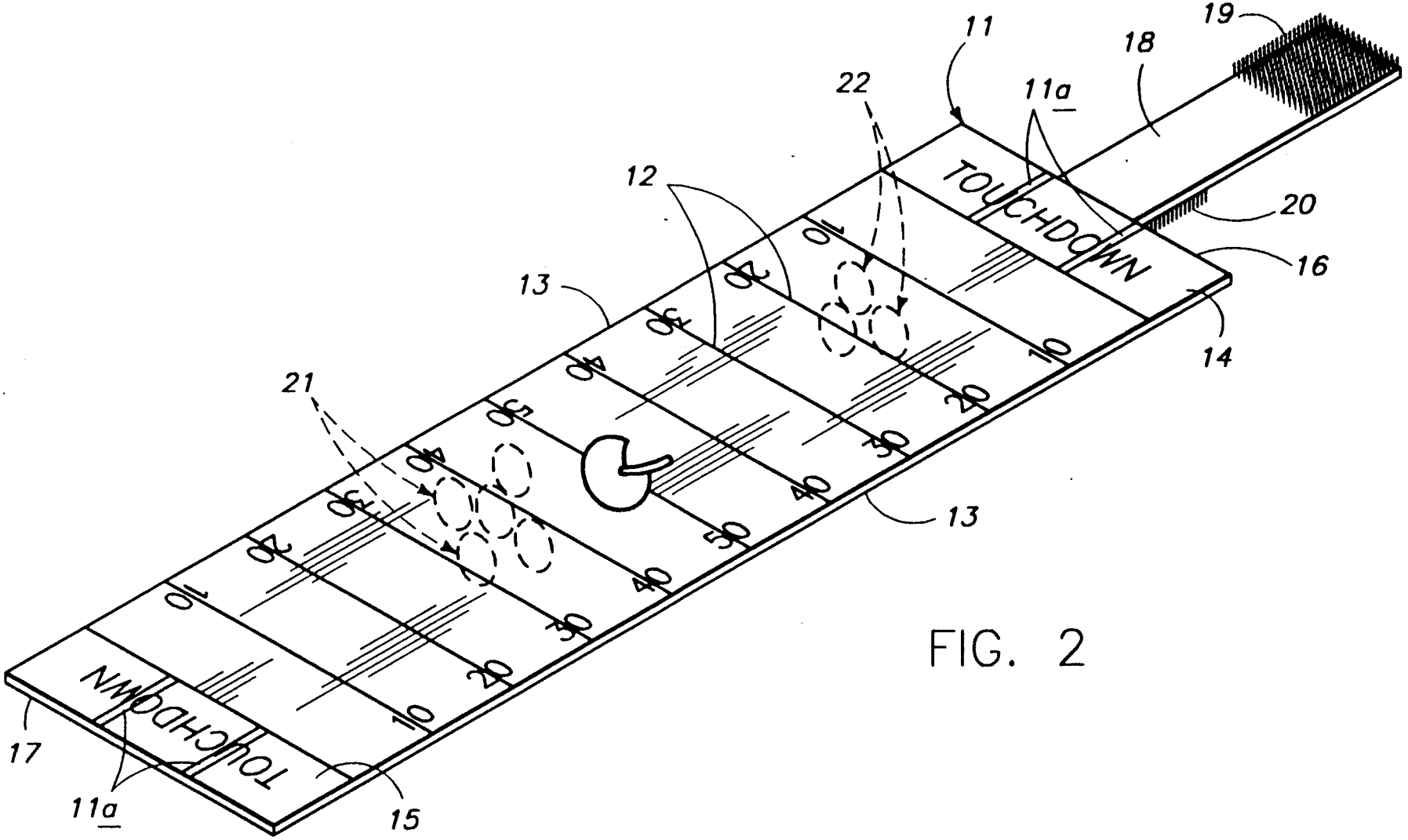
FIG. 2 is an isometric illustration of the football game board of the invention.
Figure 3:
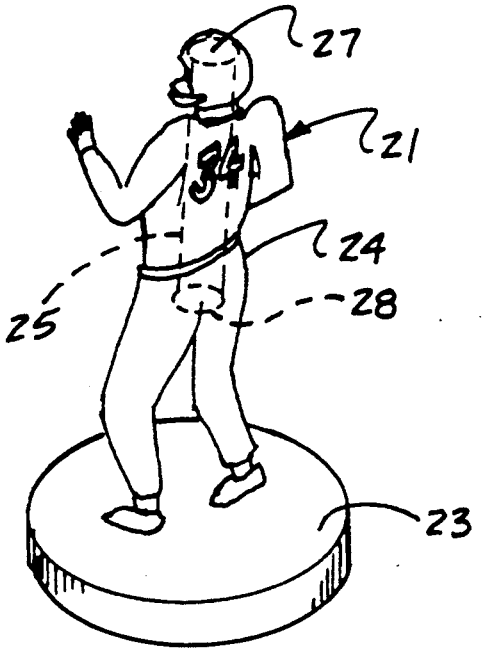
FIG. 3 and FIG. 4 are isometric illustrations representative of first and second categories of players employed by the invention.
Figure 4:
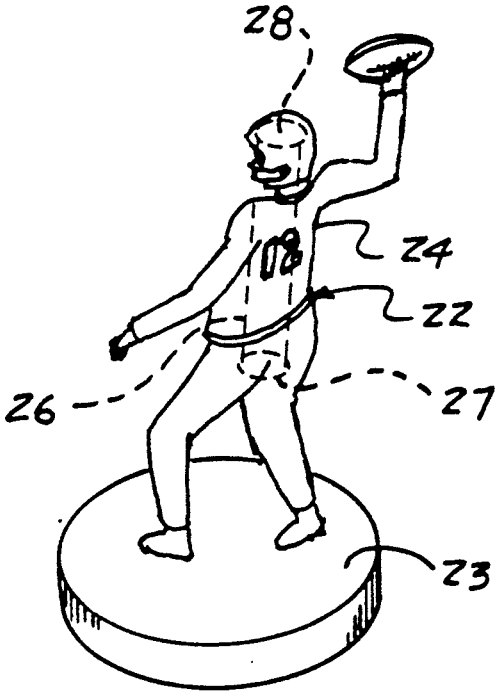

With reference now to the drawings, and in particular to FIGS. 1 to 8 thereof, a new and improved football board game embodying the principles and concepts of the present invention and generally designated by the reference numerals 11-37 will be described.

More specifically, the game of the invention essentially comprises a game directed to the simulation of a football passing procedure and limited to that manner of directing players along the game board 11. The game board 11 includes parallel indicia 12 to indicate various ten yard incremental markers of a conventional representative football playing field, having side borders 13 and a first end zone 14 spaced from a second end zone 15 at the game board respective first and second ends 16 and 17. A flexible strap 18 includes respective first and second hook and loop fasteners 19 and 20 mounted to opposed ends and respective top and bottom surfaces of the flexible strap 18 permitting furling of the game board during periods of non-use and storage about a mandrel 30, having coaxially aligned handles 31 arranged for storing of the game board 11 between spaced parallel discs, as indicated in FIG. 6.

The game apparatus includes respective first and second categories of players 21 and 22, wherein an equal number of such players are awarded opposing players employing the apparatus, wherein each player of the first and second categories of players 21 and 22 respectively includes a player base 23 having a representative figure mounted thereon, wherein each representative figure includes a torso 24 spaced from the base 23. The respective first and second torsos of the respective first and second players 21 and 22 include first and second bar magnets 25 and 26, wherein the first bar magnet 25 includes a first magnetic pole 27 oriented at an uppermost end of the representative player, wherein the magnetic second pole 28 is arranged in facing relationship relative to and spaced from the associated base 23. The second category of players 22 is such that each of the players includes the second bar magnetic 26 oriented such that the first magnetic pole 27 is in facing relationship relative to and spaced from the base 23, while the second magnetic pole 28 is spaced at an uppermost distal end of the second category of player. The game ball 33 of the invention includes a resilient outer sheath 34 having a central magnetic core 35, wherein the central magnetic core 35 includes a first magnetic pole 36 oriented at a first end of the game ball 33, with a second magnetic pole 37 oriented at a second end of the game ball 33, wherein a rod bat 29 employed to strike the game ball 33 is such that when similar first poles of the core 35 and of the first and second categories of player magnets and their associated poles are dissimilar, the game ball will be somewhat attracted to that player in striking but should the orientation of similar magnetic poles of the game ball be in adjacency, the game ball will tend to deflect. It is understood that the employment of the first and second magnets 25 and 26, as well as the employment of the central magnetic core 35 within the game ball 33 is an optional feature that may be employed as desired in play of the game, where it is understood that the players may be configured without such magnetic construction and the ball may accordingly be free of such magnetic orientation within the game ball.

Figure 7:
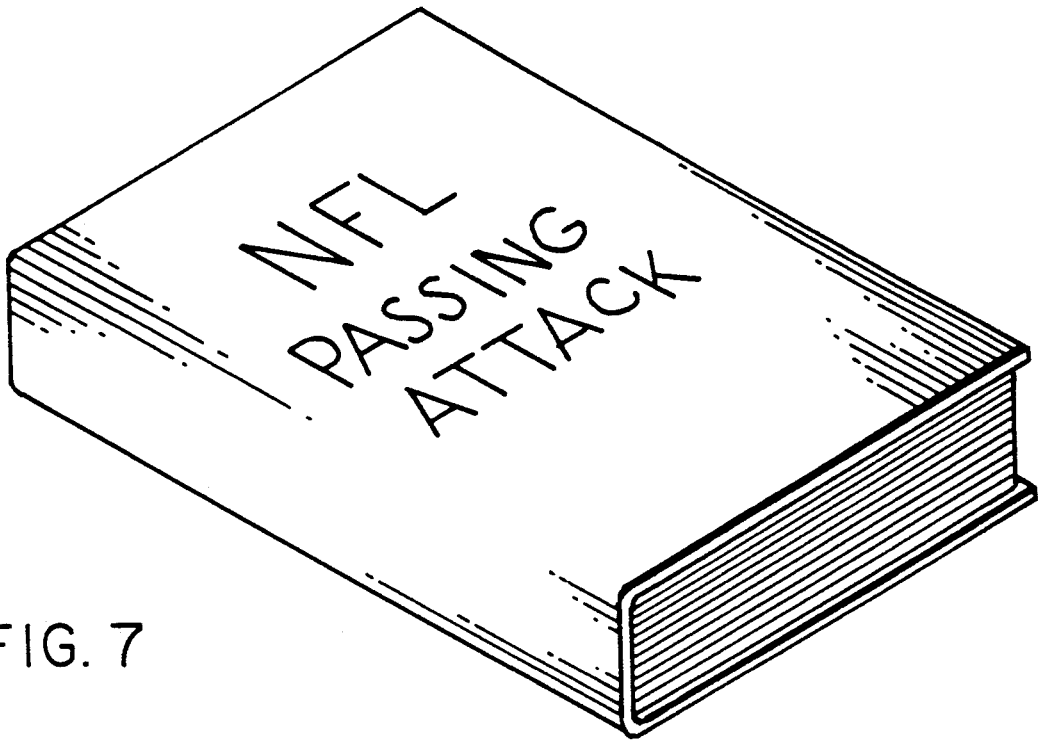
FIG. 7 is an isometric illustration of a typical presentation of a rule book employing conventional football game rules.
Figure 8:
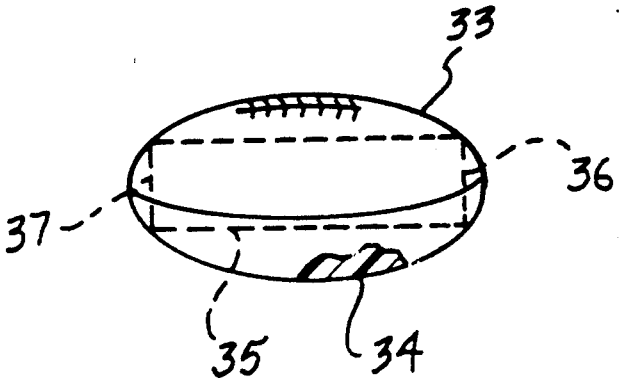
Fig. 8 is an orthographic view, partially in section, of the game ball employed by the invention.

In play of the game, the rules are consistent with National Football League (R) rules, such that a touchdown is six points, with a point after, one point, a safety is two points, and the like. Initiation of play is directed by a player tossing a coin and the winner of such toss consistent within typical NFL play initiates play on the thirty-five yard line of the game board 11, wherein the only deviation relative to regular football rule play is such that the players are provided on defense of the first category of players 21, while the second category of players 22 employs three or four players providing the defense with a bit of advantage to provide the defending player the opportunity to position the defending players of the first category of players in orientation to impede and interfere with successful striking of an offensive player with the game ball 33 upon striking the game ball 33 with the bat 29 by the offensive team player. In the kickoffs, the receiving team may have six players on the field that may be placed as desired beyond the receiving players' ten yard line, wherein contact to the receiving team indicating where the game is to initiate, such as in typical football play. Should the ball strike the receiving teams' end zone, a touchback is afforded and the ball is spotted on the receiving teams' twenty yard line. If the kicking team missed the ball with the bat, the ball is positioned where the ball strikes, even if the ball did proceed beyond the kicking teams' thirty-five yard line. The offensive players are manipulated by the dowel and may be only contacted once for such positioning. If they are contacted twice in a single formation maneuver, a false start is indicated with an associated penalty to direct the offensive players backward affording them a penalty of five to ten yards as decided upon by the participants in the game. When all offensive players of the second category of players 22 have been directed beyond the line of scrimmage for a pass, then the defensive or first category of players are positioned by the opponent to try to hinder the path of the game ball towards striking the offensive players or second category of players 22. The defending player is directed to be within ten yards of the receiving or second category of players, wherein should that not be the case then the attempted passing is incomplete, it is to be considered pass interference with the offensive team or second category of players and the opponent be awarded a ten yard penalty directed against the defensive or first category of players 21. Should the game ball 33 thrust one of the second category of players 22 forwardly beyond where the ball strikes the player, the orientation of the second category of player upon the game board 11 dictates where the play stops. If the ball 33 does not strike any player piece, it is incomplete and the down is simply replayed in typical football rule manner. If the ball during play hits a defensive player or first category of player 21, prior to it being directed from the playing field and the like, the game dictates an interception and the defending team takes over as the offensive team. Touchdowns record in a conventional manner, an offensive player being struck by the ball in the defending teams' end zone. Also the thrust of the ball directs the offensive player or second category of player into the opposing teams' end zone. Further, to permit point after touchdowns and field goals and the like, simulated goal posts 11*a* are positioned in each end zone to dictate proper pass of the ball over the end zone markers 11*a* to credit the kicking team with a point after touchdown of a three point field goal, as indicated by play of the game. The use of "blitzing" is availed, wherein the defending team or first category of players 21 announces the word and prior to the opponent or offensive team or the second category of players 22 using the wand or bat to strike the ball 33, the defending opponent moves his player such as to contact the line of scrimmage prior to the offensive opponent striking the ball 33 with the bat 29. In such event, a loss of down is afforded the offensive team. The offensive opponent of the second category of players 22 may employ "rolling out" by positioning the ball 33 on the game board 11 and by employing the dowel 29 upon a blitz, manipulating the ball laterally relative to blitzing. A "safety" is recorded when during an attempted passing procedure, from one of the end zones, the pass fails and the ball does not come in contact with one of the second category of players 22, a safety is afforded the defending or first category of players 21, or one of the second category of players 22 is credited with the reception of the ball in contact with the ball in that player's end zone. Even "illegal motion" is afforded when employing the dowel to manipulate a player on the game board, the dowel misses and a second attempt is attempted to manipulate the player, then illegal motion is afforded that moving player and five yards is assessed against that player and team. It should be understood that the opposing teams may employ conventional football rules as desired to enhance play of the game in accommodation of the apparatus as employed, wherein the above noted rules are merely exemplary and are not considered to be limiting relative to play and enjoyment of the game structure. The game structure is availed to accommodate variations of play limited only by the imagination of the opponents in play of the game based upon typical National Football League rules as may be provided in a copy form within the organization, such as indicated in FIG. 7.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A football board game arranged for employing conventional football rules and including a flexible game board, having a representative football playing field imparted thereon, with the game board including spaced parallel side borders, with parallel indicia directed orthogonally between the side borders, and a game board first end spaced from a game board second end, and a first end zone indicated between the indicia and the game board first end and a second end zone indicated between the indicia and the game board second end, and representative first and second goal post members imparted upon the respective first and second end zones, and a first category of players and a second category of players, and a bat member, and a game ball, wherein the bat member is directed to strike the game ball to strike the second category of players to complete a pass to the second category of player, and wherein the first category of player is positioned upon the game board and upon the indicia to interfere with said pass, and the game board includes a flexible strap extending from the game board first end, with the flexible strap having a first hook and loop fastener spaced from a second hook and loop fastener, and further including a cylindrical mandrel having spaced parallel discs spaced apart in a predetermined spacing, and wherein the game board side boards are spaced apart said predetermined spacing to permit furling of the game board between the discs and securement of the game board by securing the first hook and loop fastener to the second hook and loop fastener when the game board is furled about the mandrel between the discs.

2. A game board as set forth in claim 1 wherein the first category of players and the second category of players include a respective first and second player base, and the first category of players includes a first representative figure, and the second category of players includes a second representative figure, the first representative figure includes a first torso, the second representative figure includes a second torso, wherein the first torso includes a first bar magnet, the second torso includes a second bar magnet, with the first bar magnet oriented within the first torso, with a first bar magnet first magnetic pole spaced from a first bar magnet second magnetic pole, and the first magnetic pole arranged in facing relationship relative to the first base, and the second torso having said second bar magnet positioned within the second torso, with the second bar magnet having a second bar magnet first magnetic pole and a second magnetic pole spaced relative to one another, and the second bar magnet first magnetic pole is arranged in facing relationship relative to the second base, and wherein the game ball is formed of a resilient outer sheath having a central magnetic core, the central magnetic core including a magnetic core first magnetic pole at a first end of the game ball, and a magnetic core second magnetic pole at a second end of the game ball.

* * * * *